US006668803B1

(12) United States Patent
McClean et al.

(10) Patent No.: US 6,668,803 B1
(45) Date of Patent: Dec. 30, 2003

(54) FUEL INJECTOR RETENTION ARRANGEMENT

(75) Inventors: Richard A. McClean, Casco Township, MI (US); Chris Sungyong Jung, Troy, MI (US); Joseph F. Basmaji, West Bloomfield, MI (US); Jeffrey E. Bautz, Macomb, MI (US); Bernhard J. Reif, Dearborn, MI (US); Laural S. Feldmeier, Allen Park, MI (US); Michael R. Kaput, Canton, MI (US); Walter Jasiolek, Northville, MI (US); William B. Fort, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/065,947

(22) Filed: Dec. 3, 2002

(51) Int. Cl.[7] ..... F02M 37/04
(52) U.S. Cl. ..... 123/470; 123/456
(58) Field of Search ..... 123/470, 456

(56) References Cited

U.S. PATENT DOCUMENTS 5,035,224 A * 7/1991 Hornby ..... 123/470
5,040,512 A * 8/1991 Twilton ..... 123/470
5,074,269 A * 12/1991 Herbon et al. ..... 123/470
5,136,999 A * 8/1992 Bassler et al. ..... 123/470
5,167,213 A * 12/1992 Bassler et al. ..... 123/470
5,520,151 A 5/1996 Gras et al.
5,803,052 A * 9/1998 Lorraine et al. ..... 123/470
6,019,089 A * 2/2000 Taylor et al. ..... 123/470
6,053,149 A * 4/2000 Lorraine et al. ..... 123/470
6,360,723 B1 3/2002 Nomura
6,382,187 B1 5/2002 Scollard et al.
6,481,420 B1 * 11/2002 Panasuk et al. ..... 123/470

* cited by examiner

*Primary Examiner*—Thomas N. Moulis
(74) *Attorney, Agent, or Firm*—Daly, Crowley & Mofford, LLP; Julia Voutyras

(57) ABSTRACT

A resilient clip for retaining a fuel injector housing to a fuel rail cup. The clip includes a pair of opposing sidewalls. Each one of the pair of opposing sidewalls of the clip has a frontal portion and a rear portion. The frontal portion has a pair of inwardly extending shoulders for insertion into a pair of opposing slotted regions into the fuel injector housing. The frontal portion includes a pair of opposing slots formed in the frontal sidewall portions of the clip. The slots of the clip are elevated above the shoulders therein for receiving portions of the lip of the cup. The rear portion has a pair of opposing sidewalls and a backwall. The opposing sidewalls and the backwall of the rear portion of the rear portion form a slot for the clip. The slot is for receiving a tab of the fuel rail cup. When the injector housing, clip, and cup are assembled, the lip of the cup is disposed in the slots of the clip, the shoulders of the clip are disposed in the slotted region of the fuel injector housing, and the tab is disposed within the slot of the clip. Circumferential rotation of the clip about the longitudinal axis of the cup relative to the cup is restrained by engagement of sidewalls of the tab of the cup with the sidewalls of the clip. Circumferential rotation of the clip relative to the injector housing is restrained by engagement of the stops with edges of the shoulders of the clip. Axial motion of the fuel injector housing relative to the cup is restrained by engagement of the shoulders of the clip with the slotted portion of the fuel injector housing and by engagement of the lip of the cup with edges of the slots in the clip.

2 Claims, 3 Drawing Sheets

FUEL INJECTOR RETENTION ARRANGEMENT

BACKGROUND OF INVENTION

Technical Field

This invention relates to the assembly of a fuel injector in a fuel rail cup and more particularly to an improved clip for retaining an associated fuel injector in a corresponding fuel rail cup against axial and relative circumferential rotation.

BACKGROUND OF THE INVENTION

It is known in the art relating to the assembly of a fuel injector in a fuel rail cup to use a U-shaped spring clip as the connecting member. In current assemblies, where split or bent stream fuel delivery is employed, it is necessary to provide accurate fuel injector orientation relative to the fuel rail cup. Such accurate injector orientation must be maintained in service.

Several arrangements of clip, fuel injector and fuel rail cup connections have been employed.

One type of arrangement provides a flat portion of a lower clip groove in an injector, or a radially extending flat portion of an injector, that engages with a corresponding flat portion of the clip. This engagement with the flat portion is intended to prevent the injector from rotating to ensure correct targeting of the fuel spray. However, upon repeated turning of the injector, the flats on the injector or radially extending portion become worn away and the injector becomes misaligned.

In other arrangements, the spring clip includes raised tangs formed in the clip which engage a corresponding feature on the fuel injector and fuel rail cup to orient the injector in the cup. The application of rotational force to the injector in this arrangement has been found to cause the tangs to bend and allow the injector to become misaligned in service.

In current arrangements, an injector orifice is oriented relative to an electrical connector. The electrical connector is referenced to a clip groove in the injector and the injector clip is oriented by the clip groove. Features within the clip relate the clip groove location feature to the clip sides. The clip sides are located to a tab on the injector cup, and the injector cup is oriented to the fuel rail mounting feature, such as screw holes. The fuel rail is oriented to the manifold and the manifold is oriented to the head and eventually to the inlet valves, the desired target. This arrangement results in a large cumulative alignment tolerance. Location is limited by the feature easiest overcome which is the clip to clip groove interface which provides generally about 11 to 15 in. lb. of resistance torque for first time rotation. Once the injector has been rotated, the resistance to subsequent rotations drops off significantly.

Another arrangement is described in U.S. Pat. No. 5,803,052. There, an improved spring clip for retaining together a fuel injector and a fuel rail clip that fixes an associated fuel injector against axial and rotational movement relative to a corresponding fuel rail cup. More specifically, the spring clip of the invention includes a key feature or aperture for receiving, and retaining therein, corresponding radially protruding keys of an injector and a fuel rail cup. While such arrangement operates effectively, it would be desirable to have an arrangement which can operate with a wide variety of fuel injectors and fuel injector cups.

SUMMARY OF INVENTION

In accordance with one feature of the invention, a resilient clip is provided for retaining a fuel injector housing to a fuel rail cup. The clip includes a pair of opposing sidewalls. Each one of the pair of opposing sidewalls of the clip has a frontal portion and a rear portion. The frontal portion has a pair of inwardly extending shoulders for insertion into a pair of opposing slotted regions in a fuel injector housing. The pair of opposing slotted regions are separated by stops in the fuel injector housing. The frontal portion includes a pair of opposing slots formed in the frontal sidewall portions of the clip. The slots of the clip are elevated above the shoulders therein for receiving portions of the lip of the cup. The rear portion has a pair of opposing sidewalls and a backwall. The opposing sidewalls and the backwall of the rear portion of the rear portion form a slot for the clip. The slot is for receiving a tab of the fuel rail cup. When the injector housing, clip, and cup are assembled, the lip of the cup is disposed in the slots of the clip, the shoulders of the clip are disposed in the slotted region of the fuel injector housing, and the tab is disposed within the slot of the clip. Circumferential rotation of the clip about the longitudinal axis of the cup relative to the cup is restrained by engagement of sidewalls of the tab of the cup with the sidewalls of the clip. Circumferential rotation of the clip relative to the injector housing is restrained by engagement of the stops with edges of the shoulders of the clip. Axial motion of the fuel injector housing relative to the cup is restrained by engagement of the shoulders of the clip with the slotted portion of the fuel injector housing and by engagement of the lip of the cup with edges of the slots in the clip.

In accordance with another feature of the invention, a fuel injector retention arrangement is provided having a fuel injector housing, a fuel cup and a resilient clip. The fuel injector housing has a longitudinal axis. The housing has a pair of opposing slotted regions. The slotted regions are separated by stops in the fuel injector housing. The slotted regions are disposed circumferentially about the longitudinal axis in a portion of sidewalls the fuel injector housing. The fuel rail cup is disposed over the fuel injector housing. The cup has a lip. The lip has an axis aligned with the longitudinal axis of the fuel injector housing. The lip extends radially outward from the axis of the cup and terminates in a tab portion. The tab portion extends outwardly from a portion of the lip. The tab portion has opposing sidewalls, such sidewalls terminating in a backwall. The resilient clip has a pair of opposing sidewalls. Each one of the pair of opposing sidewalls of the clip has a frontal portion and a rear portion. The frontal portion of the opposing sidewalls of the clip has: a pair of inwardly extending shoulders for insertion into the slotted region into the fuel injector housing and; a pair of opposing slots formed in the frontal sidewall portions of the clip. The slots of the clip are elevated above the shoulders therein for receiving portions of the lip of the cup. The rear portion of the opposing sidewalls of the clip have opposing sidewalls and a backwall. The pair of opposing sidewalls of the rear portion and the backwall of such rear portion forming a slot for the clip. The slot receives the tab of the cup. The lip of the cup is disposed in the slots of the clip. The shoulders of the clip are disposed in the slotted region of the fuel injector housing. The tab is disposed within the slot of the clip.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
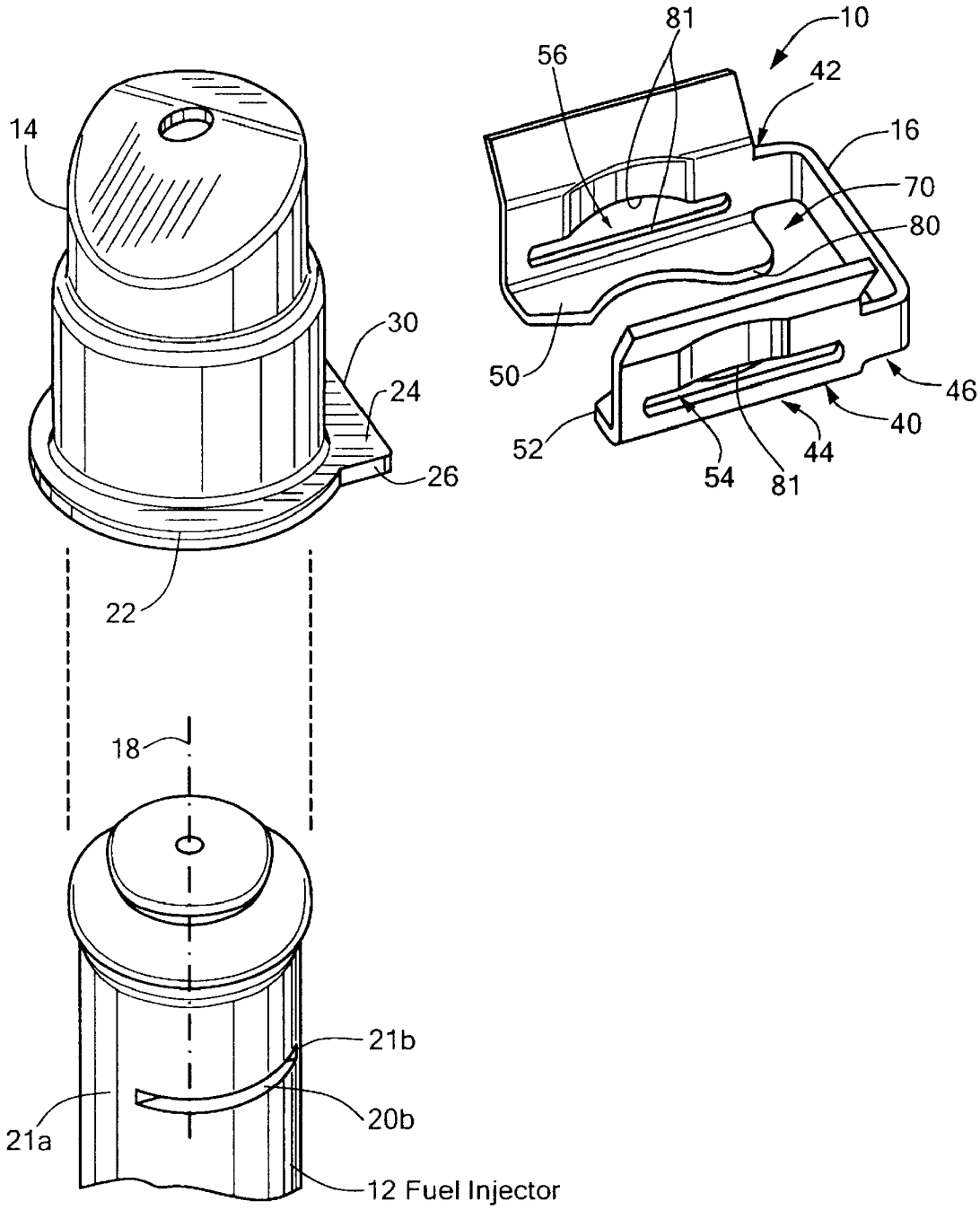
FIG. 1 is a exploded, isometric view of the fuel injector retention arrangement according to the invention.
Figure 2:
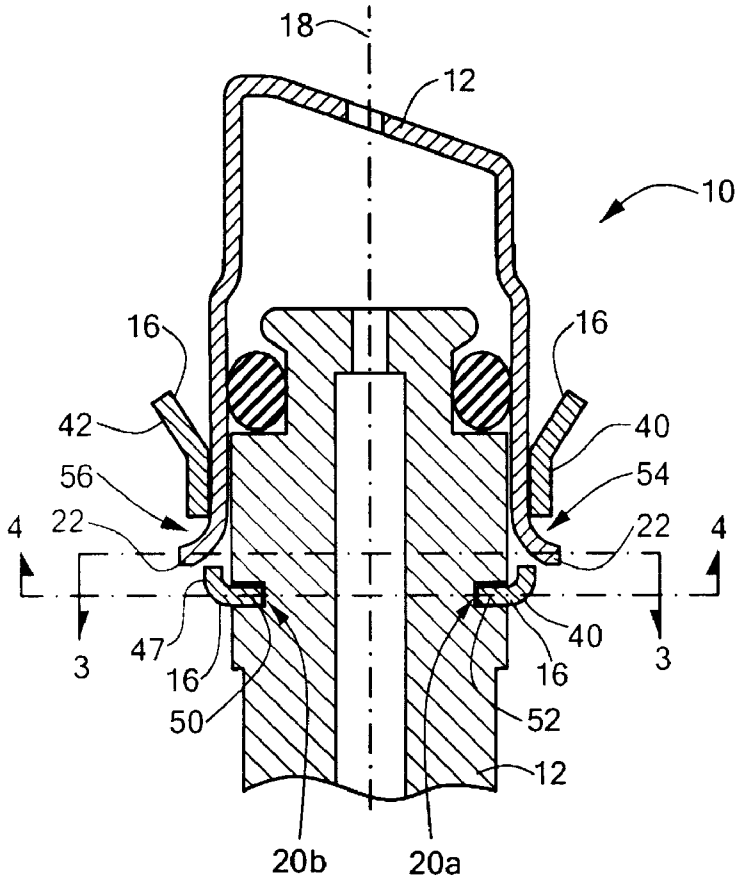
FIG. 2 is a cross-sectional view of the fuel injector arrangement of FIG. 1.

Referring now to FIGS. 1 and 2, a fuel injector retention arrangement 10 is provided having a fuel injector housing 12, a fuel cup 14, adapted for fixedly attaching to a fuel rail, not shown; and a resilient or spring-like clip 16. The clip 16 may be plastic or metal, for example.

The fuel injector housing 12 has a longitudinal axis 18. The housing 12 has a pair of slotted regions 20*a*, 20*b* therein, such slotted regions 20*a*, 20*b* being more clearly shown in FIG. 3. The slotted regions 20*a*, 20*b* are disposed circumferentially about the longitudinal axis 18 in only a fractional portion of sidewalls the fuel injector housing 12. The housing 12 has a pair of opposing stops 21*a*, 21*b* disposed between the opposing slotted regions 20*a*, 20*b*.

The fuel rail cup 14 is disposed over the fuel injector housing 12. The fuel injector cup 14 has a lip 22, shown also in FIG. 4. The lip 22 has an axis co-aligned with the longitudinal axis 18 of the fuel injector housing 12 (FIG. 2). The lip 22 extends radially outward from the axis of the cup 14 and terminates in a tab portion 24. The tab portion 24 extends outwardly from a portion of the lip. 22, as shown also in FIG. 4. The tab 24 portion has opposing sidewalls 26, 28 (FIG. 4), such sidewalls 26, 28 terminating in a backwall 30.

Figure 3:
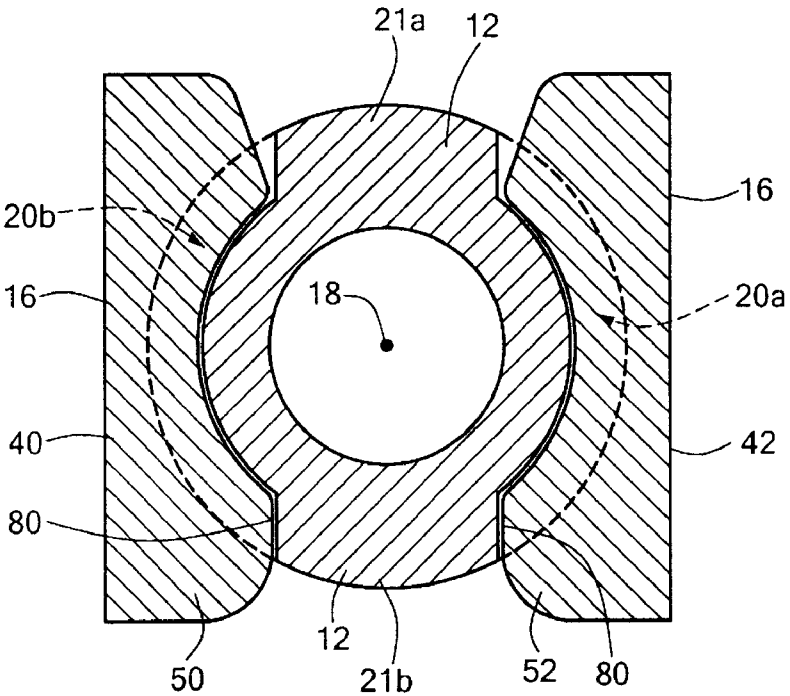
FIG. 3 is a cross sectional view of the fuel injector arrangement of FIG. 2, such cross section being taken along lines 3—3 in FIG. 2.
Figure 4:
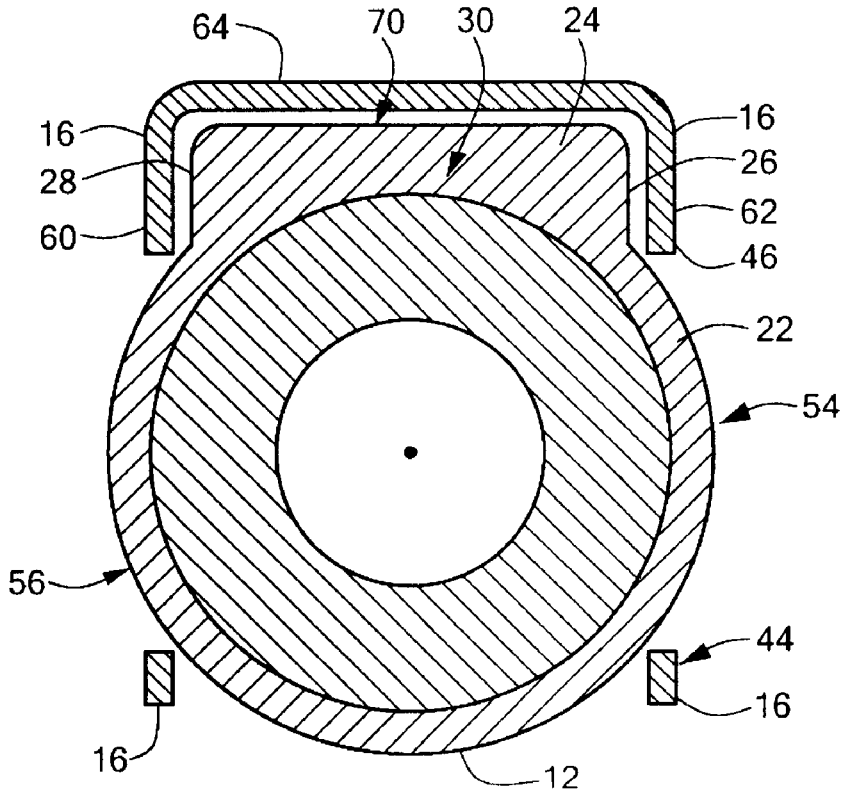
FIG. 4 is a cross sectional view of the fuel injector arrangement of FIG. 2, such cross section being taken along lines 4—4 in FIG. 2.
Figure 5:
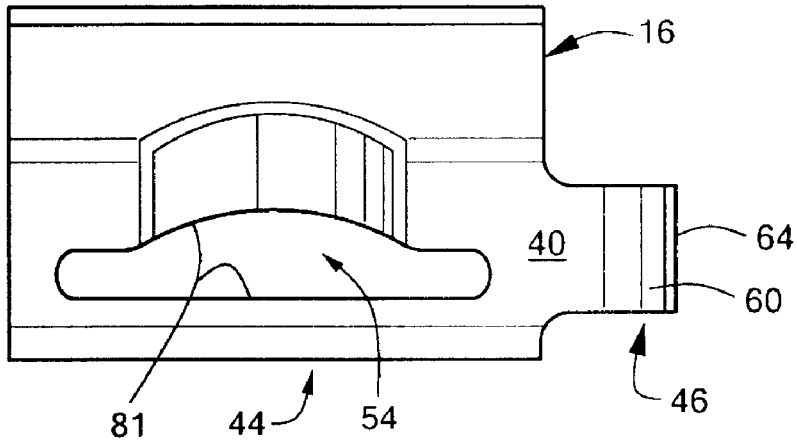
FIG. 5 is a side elevation view of a clip used in the assembly of FIG. 1.

The resilient clip 16 has a pair of opposing sidewalls 40, 42 (FIGS. 1, 2, 3 and 5). Each one of the pair of opposing sidewalls 40, 42 of the clip 16 has a frontal portion 44 and a rear portion 46 (FIGS. 1 and 4). The frontal portion 44 of the opposing sidewalls 40, 42 of the clip 16 has: a pair of inwardly extending shoulders 50, 52 for insertion into the slotted region 20 into the fuel injector housing 12 and; a pair of opposing slots 54, 56 formed in the frontal sidewall 40, 42 portions 44 of the clip 16. The slots 54, 56 of the clip are elevated above the shoulders 50, 52 therein for receiving portions of the lip 22 of the cup 16 (FIG. 2). The rear portion 46 of the opposing sidewalls 40, 42 of the clip 16 have opposing sidewalls 60, 62 and a backwall 64. The pair of opposing sidewalls 60, 62, of the rear portion 44 and the backwall 63 of such rear portion 46 forming a slot 70 (FIGS. 1 and 3) for the clip 16. It is noted in FIG. 3 that the backwall 70 of the tab 30 is disposed between the longitudinal axis 18 of the cup and the backwall 64 of the clip 16.

The slot 16 receives the tab portion 30 of the cup 14 (FIGS. 1 and 4). The lip 22 of the cup 16 is disposed in the slots 54, 56 of the clip 16, FIG. 4. The shoulders 50, 52 of the clip 16 are disposed in the slotted regions 20*a*, 20*b* (FIGS. 1 and 3) of the fuel injector housing 12. The tab 30 is disposed within the slot 70 of the clip 16, FIG. 4.

Circumferential rotation of the clip 16 about the longitudinal axis of the cup 14 relative to the cup 14 is restrained by engagement of sidewalls 26,28 of the tab portion 30 of the cup 14 with the sidewalls 60, 62 of the clip 16, as shown in FIG. 4. Circumferential rotation of the clip 16 relative to the injector housing 12 is restrained by engagement of the stops 21*a*, 21*b* (FIG. 3) with edges 80 of the shoulders 50 of the clip 16, as shown in FIG. 3.

Axial motion of the fuel injector housing 12 relative to the cup 14 is restrained by engagement of the shoulders 40, 42 of the clip 16 with the slotted portions 20*a*, 20*b* of the fuel injector housing 12 and by engagement of the lip 22 of the cup 14 with edges 81 (FIG. 5) of the slots 54, 55 in the clip 16.

A number of embodiments of the invention have been described. Nevertheless, it will be understood that various modifications may be made without departing from the spirit and scope of the invention. Accordingly, other embodiments are within the scope of the following claims.

What is claimed is:

1. A fuel injector retention arrangement, comprising:

(A) a fuel injector housing having a longitudinal axis, such housing having:

(a) a pair of opposing slotted regions therein, such slotted regions being disposed circumferentially about the longitudinal axis in a portion of sidewalls of the fuel injector housing;

(b) a pair of stops disposed between the pair of slotted regions;

(B) a fuel rail cup disposed over the fuel injector housing having:

a lip, such lip being disposed about an axis aligned with the longitudinal axis of the fuel injector housing, such lip terminating in a tab portion, such tab portion extending outwardly from a portion of the lip, such tab portion having opposing sidewalls, such sidewalls terminating in a backwall;

(C) a resilient clip, such clip having:

a pair of opposing sidewalls, each one of the pair of opposing sidewalls of the clip having a frontal portion and a rear portion, such frontal portion having:

a pair of inwardly extending shoulders for insertion into the slotted region into the fuel injector housing and;

a pair of opposing slots formed in the frontal sidewall portions of the clip, such slots of the clip being elevated above the shoulders therein for receiving portions of the lip of the cup;

such rear portion having the opposing sidewalls and backwall, such pair of opposing sidewalls of the rear portion and the backwall of such rear portion forming a slot for the clip, such slot for receiving the tab of the cup; and (D) wherein, (a) the lip of the cup is disposed in the slot of the clip;

(b) the shoulders of the clip are disposed in the slotted regions of the fuel injector housing;

(c) the tab is disposed within the slot of the clip;

(d) the backwall of the tab being disposed between the longitudinal axis of the cup and the backwall of the clip;

(e) circumferential rotation of the clip about the longitudinal axis of the cup relative to the cup being restrained by engagement of sidewalls of the tab of the cup with the sidewalls of the clip;

(f) circumfrential rotation of the clip relative to the injector housing being by engagement of the stops with edges of the shoulders of the clip;

(g) axial motion of the fuel injector housing relative to the cup being restrained by engagement of the shoulders of the clip with the slotted portion of the fuel injector housing and by engagement of the lip of the cup with edges of the slots in the clip.

2. A resilient clip for retaining a fuel injector housing to a fuel rail cup, such clip comprising:

a pair of opposing sidewalls, each one of the pair of opposing sidewalls of the clip having a frontal portion and a rear portion, such frontal portion having:

a pair of inwardly extending shoulders for insertion into a pair of opposing slotted regions in a fuel injector housing, such slotted regions having stops and;

a pair of opposing slots formed in the frontal sidewall portions of the clip, such slots of the clip being elevated above the shoulders therein for receiving portions of a lip of the cup;

such rear portion having the opposing sidewalls and backwall, such pair of opposing sidewalls of the rear portion and the backwall of such rear portion forming a slot for the clip, such slot for receiving a tab of the cup; and wherein when the injector housing, clip, and cup are assembled, (a) the lip of the cup is disposed in the slot of the clip;

(b) the shoulders of the clip are disposed in the slotted regions of the fuel injector housing;

(c) the tab is disposed within the slot of the clip;

(d) the backwall of the tab being disposed between the longitudinal axis of the cup and the backwall of the clip;

(e) circumferential rotation of the clip about the longitudinal axis of the cup relative to the cup being restrained by engagement of sidewalls of the tab of the cup with the sidewalls of the clip;

(f) circumfrential rotation of the clip relative to the injector housing being by engagement of the stops with edges of the shoulders of the clip;

(g) axial motion of the fuel injector housing relative to the cup being restrained by engagement of the shoulders of the clip with the slotted portion of the fuel injector housing and by engagement of the lip of the cup with edges of the slots in the clip.

* * * * *